US006966833B2

(12) United States Patent
Kaminkow et al.

(10) Patent No.: US 6,966,833 B2
(45) **Date of Patent: *Nov. 22, 2005**

(54) GAMING DEVICE HAVING VALUE SELECTION BONUS

(75) Inventors: Joseph E. Kaminkow, Reno, NV (US); Jean M. Brossard, Reno, NV (US); Anthony J. Baerlocher, Reno, NV (US); Joseph R. Hedrick, Reno, NV (US); Lance R. Peterson, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/803,410

(22) Filed: Mar. 17, 2004

(65) Prior Publication Data

US 2004/0204219 A1 Oct. 14, 2004

Related U.S. Application Data

(63) Continuation of application No. 10/306,295, filed on Nov. 27, 2002, now Pat. No. 6,722,981, which is a continuation of application No. 09/684,605, filed on Oct. 6, 2000, now Pat. No. 6,514,141.

(51) Int. Cl.[7] ..... A63F 9/24
(52) U.S. Cl. ..... 463/16
(58) Field of Search ..... 463/16–22

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,342,047 | A | 8/1994 | Heidel et al. |
| 5,456,465 | A | 10/1995 | Durham |
| 5,524,888 | A | 6/1996 | Heidel |
| 5,536,016 | A | 7/1996 | Thomson |
| 5,542,669 | A | 8/1996 | Charron et al. |
| 5,560,603 | A | 10/1996 | Seelig et al. |
| 5,611,535 | A | 3/1997 | Tiberio |
| 5,711,525 | A | 1/1998 | Breeding |
| 5,769,716 | A | 6/1998 | Saffari et al. |
| 5,772,509 | A | 6/1998 | Weiss |

(Continued)

FOREIGN PATENT DOCUMENTS

EP 0874337 A1 10/1998

(Continued)

OTHER PUBLICATIONS

Addams Family Entertainment Advertisement written by IGT and Strictly Slots, published in 2000.

(Continued)

*Primary Examiner*—Michael O'Neill
(74) *Attorney, Agent, or Firm*—Bell, Boyd & Lloyd, LLC

(57) ABSTRACT

A gaming device that provides a player with an opportunity to maximize a gaming device award. The gaming device presents the player with a display having a plurality of symbols and enables the player to choose one or more of the symbols. The game reveals the award(s) associated with the selected symbols but does not reveal which awards are associated with which symbols. The game then provides the player with one or more opportunities to upgrade the total award by deselecting one or more of the selected symbols and re-selecting another symbol for each deselected symbol.

97 Claims, 7 Drawing Sheets

U.S. PATENT DOCUMENTS

| | | | |
|---|---|---|---|
| 5,775,692 | A | 7/1998 | Watts et al. |
| 5,788,573 | A | 8/1998 | Baerlocher et al. |
| 5,813,911 | A | 9/1998 | Margolin |
| 5,823,874 | A | 10/1998 | Adams |
| 5,833,538 | A | 11/1998 | Weiss |
| 5,848,932 | A | 12/1998 | Adams |
| 5,851,148 | A | 12/1998 | Brune et al. |
| 5,873,781 | A | 2/1999 | Keane |
| 5,882,261 | A | 3/1999 | Adams |
| 5,902,184 | A | 5/1999 | Bennett et al. |
| 5,911,418 | A | 6/1999 | Adams |
| 5,947,820 | A | 9/1999 | Morro et al. |
| 5,951,397 | A | 9/1999 | Dickinson |
| 5,964,463 | A | 10/1999 | Moore, Jr. |
| 5,967,894 | A | 10/1999 | Kinoshita et al. |
| 5,980,384 | A | 11/1999 | Barrie |
| 5,984,781 | A | 11/1999 | Sunaga |
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,019,369 | A | 2/2000 | Nakagawa et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mango et al. |
| 6,062,980 | A | 5/2000 | Luciano |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,798 | A | 8/2000 | Bennett |
| 6,120,031 | A | 9/2000 | Adams |
| 6,126,541 | A | 10/2000 | Fuchs |
| 6,126,542 | A | 10/2000 | Fier |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,273 | A | 11/2000 | Olsen |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| 6,210,279 | B1 | 4/2001 | Dickinson |
| 6,213,876 | B1 | 4/2001 | Moore, Jr. |
| 6,224,483 | B1 | 5/2001 | Mayeroff |
| 6,227,971 | B1 | 5/2001 | Weiss |
| 6,231,442 | B1 | 5/2001 | Mayeroff |
| 6,231,445 | B1 | 5/2001 | Acres |
| 6,234,897 | B1 | 5/2001 | Frohm et al. |
| 6,254,481 | B1 | 7/2001 | Jaffe |
| 6,261,177 | B1 | 7/2001 | Bennett |
| 6,302,790 | B1 | 10/2001 | Brossard |
| 6,305,686 | B1 | 10/2001 | Perrie et al. |
| 6,309,300 | B1 | 10/2001 | Glavich |
| 6,328,649 | B1 | 12/2001 | Randall et al. |
| 6,375,187 | B1 | 4/2002 | Baerlocher |
| 6,398,644 | B1 | 6/2002 | Perrie et al. |
| 6,439,995 | B1 | 8/2002 | Hughs-Baird et al. |
| 6,565,432 | B2 | 5/2003 | Moody |
| 6,572,471 | B1 | 6/2003 | Bennett |
| 6,722,982 | B2 | 4/2004 | Kaminkow et al. |
| 2002/0072402 | A1 | 6/2002 | Baerlocher |
| 2002/0155883 | A1 | 10/2002 | Baerlocher |
| 2003/0040360 | A1 | 2/2003 | Kaminkow |
| 2003/0045348 | A1 | 3/2003 | Baerlocher |
| 2003/0045350 | A1 | 3/2003 | Baerlocher |
| 2003/0060260 | A1 | 3/2003 | Gerrard |
| 2003/0064777 | A1 | 4/2003 | Baerlocher |
| 2003/0064795 | A1 | 4/2003 | Baerlocher |
| 2003/0078093 | A1 | 4/2003 | Baerlocher |
| 2003/0087693 | A1 | 5/2003 | Baerlocher |
| 2003/0157982 | A1 | 8/2003 | Gerrard |
| 2003/0162578 | A1 | 8/2003 | Baerlocher |
| 2003/0162584 | A1 | 8/2003 | Hughs-Baird |
| 2003/0181233 | A1 | 9/2003 | Baerlocher |
| 2003/0199314 | A1 | 10/2003 | Baerlocher |
| 2003/0224846 | A1 | 12/2003 | Baerlocher |
| 2004/0009805 | A1 | 1/2004 | Baerlocher |

FOREIGN PATENT DOCUMENTS

| | | |
|---|---|---|
| EP | 0926645 A2 | 6/1999 |
| EP | 0944030 A2 | 9/1999 |
| EP | 0945837 A2 | 9/1999 |
| EP | 0981119 A2 | 2/2000 |
| EP | 0984408 A2 | 3/2000 |
| EP | 0984409 A2 | 3/2000 |
| WO | WO 9732285 | 9/1997 |
| WO | WO 00/12186 | 3/2000 |

OTHER PUBLICATIONS

Adders and Ladders Advertisement written by Barcrest, Ltd., published prior to 2000.

American Thunder Screen Shots written by IGT, published in 1998.

Big Bang Piggy Bankin Advertisement written by WMS Gaming Inc., published prior to 2000.

Blackjack/Twenty-One Description written by Hoyle's Rules of Games, published in 1993.

Bonus Spin Red, White & Blue Advertisement written by IGT, published in 2000.

Bonus Times Article written by Strictly slots, published in 2000.

By George written by IGT, published in 2002.

Caribbean Gold II Advertisement written by Aristocrat Incorporated, published in 1998.

Cash Box Brochure and Article written by Anchor Gaming, published in 2000.

Chutes & Ladders Game Instructions written by Hasbro-Milton Bradley, published in 1999.

Description of Let's Make a Deal Television Show (website) written by lestmakesadeal.com, printed Mar. 16, 2001.

Double Diamond Game Desriptions (website) written by IGT.com, printed Mar. 21, 2001.

Double Up Poker Game Description written by IGT, undated.

Easy Street Advertisements and Articles written by Casino Data Systems, published in 2000.

Elvis Advertisement written by IGT, published in 1999.

Empire Game Advertisement written by AC Coin, published in 1996.

Fire and Fortune Article written by Strictly Slots, published in 2001.

Fox "N" Hound Advertisement written by IGT, published in 2000.

In Between Game Description written by IGT, published date available prior to 2000.

Jackpot Party Brochure and Articles written by WMS Gaming, Inc, published in 1998.

Keep Your Hat On Advertisement written by Aristocrat, published in 2001.
Let's Make a Deal (website) written by geocities.com(10 pages), printed Mar. 21, 2001.
Let's Make a Deal (website) written by fortunecity.com (4 pages), printed Mar. 21, 2001.
Let's Make a Deal (website) written by Illinoislottery.com ( 1 page), printed Mar. 21, 2001.
Let's Make a Deal (website) written by geocities.com (2 pages), printed Mar. 21, 2001.
Let's Make a Deal Advertisement written by Shuffle Master and IGT, published in 1999.
Little Green Men Advertisement and Article written by IGT, Strictly Slots, published in 2000.
MegaJackpots Advertisement written by IGT, published in 1998.
Money Grab Article written by Strictly Slots, published in 2001.
Money in the Bank Advertisement written by Strictly Slots Konami, published in 2001.
Monopoly Advertisements and Articles written by WMS Gaming, Inc, Strictly Slots, published in 1998, 1999, 2000.
Monopoly Party Train Article written by Strictly Slots, published in 2002.
Neon Lights written by IGT, published in 2000.
On the Money Article written by Strictly Slots, Casino Data Systems, published in 2000.
Polly & Roger Advertisement written by VLC, Inc., published in 2000.
Price is Right "Cliff Hangers" Description (website) written by www.geocites.com; members.aol.com, printed Mar. 21, 2001.
Price is Right "Showcases" Description (website) written by schuminweb.com, printed Mar. 16, 2001.
Psycho Cash Beach Club (including knockouts) written by Barcrest, published Prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd. published in 1997.
Take Your Pick Article written by Strictly Slots, published in Mar. 2001.
Take Your Pick Brochure written by IGT/Anchor Gaming, published in 1999.
Texas Tea Advertisement written by IGT, published in 2000.
The Deals of Let's Make a Deal (website) written by fortunecity.com (2 pages), printed on Mar. 16, 2000.
The Official Let's Make a Deal (Website) written by Bally Gaming System, printed on Mar. 16, 2001.
Top Cat Advertisement written by WMS Gaming, Inc., published prior to 2000.
Top Dollar Brochure written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel of Poker Article written by Strictly Slots (Anchor Games), published in 2000.
Winning Streak Web Site Description (website) written by WMS Gaming, Inc., printed Mar. 21, 2001.
X Factor Advertisement and Website Page Written by WMS Gaming, Inc., published in 1998.

FIG.3A

32

59

SELECT ONE AWARD FROM GROUPS A, B, C & D

| | | | | | |
|---|---|---|---|---|---|
| 52 | A | AA | AAA | AAAA | AAAAA |
| 54 | B | BB | BBB | BBBB | BBBBB |
| 56 | C | CC | CCC | CCCC | CCCCC |
| 58 | D | DD | DDD | DDDD | DDDDD |

FIG.3B

32

| | | | | | |
|---|---|---|---|---|---|
| 52 | 750 | 500 | 10 | 300 | 50 |
| 54 | 500 | 300 | 50 | 750 | 10 |
| 56 | 50 | 500 | 300 | 10 | 750 |
| 58 | 300 | 750 | 10 | 50 | 500 |

FIG. 4

YOU HAVE SELECTED 60

1150 CREDITS

FIG. 5

62 EACH GROUP HAS THE AWARDS: 10 CR; 50 CR; 300 CR; 500 CR; 750 CR

YOU HAVE SELECTED 60

1150 CREDITS

FIG. 6

62 EACH GROUP HAS THE AWARDS: 10 CR; 50 CR; 300 CR; 500 CR; 750 CR

YOU HAVE SELECTED THE FOLLOWING NUMBER: 1 2 1 64

YOU HAVE SELECTED 60

450 CREDITS

GAMING DEVICE HAVING VALUE SELECTION BONUS

PRIORITY CLAIM

This application is a continuation of and claims the benefit of U.S. patent application Ser. No. 10/306,295, filed Nov. 27, 2002, now U.S. Pat. No. 6,722,981, which is a continuation of and claims the benefit of U.S. patent application Ser. No. 09/684,605, filed Oct. 6, 2000, now U.S. Pat. No. 6,514,141.

CROSS REFERENCE TO RELATED APPLICATIONS

This application is related to the following commonly-owned co-pending patent applications "GAMING DEVICE HAVING AN IMPROVED OFFER/ACCEPTANCE BONUS SCHEME," Ser. No. 09/966,884; "GAMING DEVICE HAVING OFFER AND ACCEPTANCE GAME WITH HIDDEN OFFER," Ser. No. 10/160,688; "GAMING DEVICE HAVING OFFER/ACCEPTANCE ADVANCE THRESHOLD AND LIMIT BONUS SCHEME," Ser. No. 09/838,014; "GAMING DEVICE HAVING IMPROVED OFFER AND ACCEPTANCE GAME WITH MASKED OFFERS," Ser. No. 10/086,014; "GAMING DEVICE HAVING AN OFFER AND ACCEPTANCE GAME WITH A PLAYER SELECTION FEATURE," Ser. No. 10/086,078; "GAMING DEVICE HAVING IMPROVED OFFER AND ACCEPTANCE BONUS SCHEME," Ser. No. 10/074,273; "GAMING DEVICE HAVING AN OFFER AND ACCEPTANCE SELECTION BONUS SCHEME WITH A TERMINATOR AND AN ANTI-TERMINATOR," Ser. No. 10/644,447; "GAMING DEVICE HAVING SEPARATELY CHANGEABLE VALUE AND MODIFIER BONUS SCHEME," Ser. No. 10/767,484; "GAMING DEVICE HAVING AN AWARD OFFER AND TERMINATION BONUS SCHEME," Ser. No. 10/810,146; "GAMING DEVICE HAVING A BONUS ROUND WITH MULTIPLE RANDOM AWARD GENERATION AND MULTIPLE RETURN/RISK SCENARIOS," Ser. No. 10/865,713; "GAMING DEVICE HAVING A DESTINATION PURSUIT BONUS SCHEME WITH ADVANCED AND SETBACK CONDITIONS," Ser. No. 10/920,518; and "GAMING DEVICE HAVING IMPROVED AWARD OFFER BONUS SCHEME," Ser. No. 10/937,664; "GAMING DEVICE HAVING IMPROVED AWARD OFFER BONUS SCHEME," Ser. No. 10/952,062; "GAMING DEVICE HAVING AN AWARD EXCHANGE BONUS ROUND AND METHOD FOR REVEALING AWARD EXCHANGE POSSIBILITIES," Ser. No. 10/982,518; "GAMING DEVICE HAVING RISK EVALUATION BONUS ROUND," Ser. No. 11/041,801.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having player selectable and deselectable symbols associated with awards and a method to optimize a player's award.

BACKGROUND OF THE INVENTION

Gaming devices currently exist with bonus rounds in which a player has one or more opportunities to choose masked bonus awards from a pattern of masked awards displayed to the player. When the player chooses a masked award from the pattern, the game removes the mask and either awards the player with a bonus value or terminates the bonus round with a bonus terminator. The outcome depends upon whether the player selects an award or a terminator.

In the above game, the controller of the gaming device randomly places a predetermined number of masked awards and terminators in the pattern at the beginning of the bonus round and maintains the positioning until the bonus round terminates. When the player selects a masked award, the player receives the value of the award, and the game typically displays a message that the player may continue and enables the player to select another masked award. The player then selects another masked award, and the process continues until the player selects a masked terminator. European Patent Application No. EP 0 945 837 A2 filed on Mar. 18, 1999 and assigned on its face to WMS Gaming, Inc. discloses a bonus round of this type.

Gaming machines also currently exist with bonus rounds in which the game selects or determines the player's award. PCT application PCT/AU97/00121 entitled, Slot Machine Game with Roaming Wild Card, having a publication date of Sep. 4, 1997, discloses an example. In this invention, a slot machine having a video display contains a plurality of rotatable reels with game symbols. When the player receives a triggering symbol or combination, the game produces a bonus symbol. The bonus symbol moves from game symbol to game symbol temporarily changing the game symbol to a bonus symbol. If the change results in a winning combination, the player receives an award.

In the first known game, the "go-until" or "do-until" bonus round can end quite quickly if the player selects a bonus terminator early in the bonus round. A prior selection does not affect the current selection except to the extent that one less selection exists. The player blindly selects masked symbols until selecting the bonus terminator, which is immediately displayed. The player's involvement in the bonus round is thus limited. The player has no opportunity to undo or redo an undesired pick. The player has no opportunity to optimize or maximize the bonus round award. In the second known game, the game completely determines the bonus round award, and the player has no affect on the outcome.

Bonus rounds provide gaming manufacturers with the opportunity to add enjoyment and excitement to that which is already expected from a base game of the gaming device. Excitement and enjoyment increases when the interaction level between the bonus round and the player increases, and also when the bonus round remains compelling for an extended period of time. It is therefore desirable to create a bonus round in which a current selection relates to or impacts a later selection. It is also desirable to provide a bonus round that remains compelling for an extended period of time even if the player does not ultimately fare well in the bonus round. Finally, a bonus round can increase excitement and enjoyment by providing a player an opportunity to optimize a bonus round award.

SUMMARY OF THE INVENTION

The gaming device of the present invention includes a bonus round that provides a player with an opportunity to maximize a gaming device award. The present invention presents the player with a display having a plurality of groups of masked awards. The groups each preferably contain the same awards, e.g., a 10 credit, a 20 credit, a 50 credit and a 100 credit award. The game preferably enables the player to choose a masked award from each of the groups. The game then provides the player with one or more opportunities to upgrade the total award.

The display preferably contains a touch screen that enables the player to simply touch a masked award. The game preferably does not reveal a selected award, but does provide an indication that the award has been selected. For example, the game can change the initial mask or indicia of selected symbols to a particular color. If the player deselects the previously selected award, the game preferably changes the color back to the initial mask or indicia. Alternatively, the game can highlight and unhighlight selected and deselected awards, respectively. The present invention also provides one or more optimization aids, which enable a player to maximize or optimize the player's award.

In one optimization embodiment, the player upgrades the total award having only a total award indicator, which displays the accumulation of one or more awards selected from each group, to guide the player. When the player selects a different masked award from a group, the game deselects the previously selected masked award from that group and updates the player's total. If the total is less, the player can reselect (if another selection remains) the previous award. The game preferably provides an odd number of opportunities to change, and most preferably three opportunities, so that the player must decide if the final opportunity is worth the risk of losing awards. The player may otherwise collect the current award at any time by selecting a suitable collection selector.

In another optimization embodiment, the game provides an indication of the possible awards. For example, the game can display that a 10 credit, a 20 credit, a 50 credit and a 100 credit are each available. This information enables the player to know how close the current award is to a maximum. This information is useful especially when the player has to decide whether to use a final chance to upgrade and does not have another chance to undo an undesirable selection.

In a further optimization embodiment, the game provides an indication of the possible awards and the number of each that the player has selected, which further enables the player to know how close the current award is to a maximum. The embodiment provides a breakdown of the awards selected by the player, which the player could determine knowing only the possible awards. The breakdown precludes the player from having to perform mathematical functions to properly play the bonus round and promotes expeditious play.

It is therefore an object of the present invention to provide a gaming device, wherein the game enables the player to have one or more opportunities to optimize a gaming device award.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 3A is an enlarged front elevational view of the display device of the present invention having a plurality of groups of player selectable masked awards;

FIG. 3B is an enlarged front elevational view of the display device of the present invention illustrating the awards of the plurality of groups of FIG. 3A, which have been unmasked;

FIG. 4 is schematic diagram of a total award indicator of the present invention, which comprises one optimization embodiment of the present invention;

FIG. 5 is a schematic diagram of a total award indicator and of a possible award indication of the present invention, which comprises another optimization embodiment of the present invention;

FIG. 6 is a schematic diagram of a total award indicator, a possible award indication and an award selection indication of the present invention, which comprises a further optimization embodiment of the present invention;

DETAILED DESCRIPTION OF THE INVENTION

Gaming Device and Electronics

Figure 1:
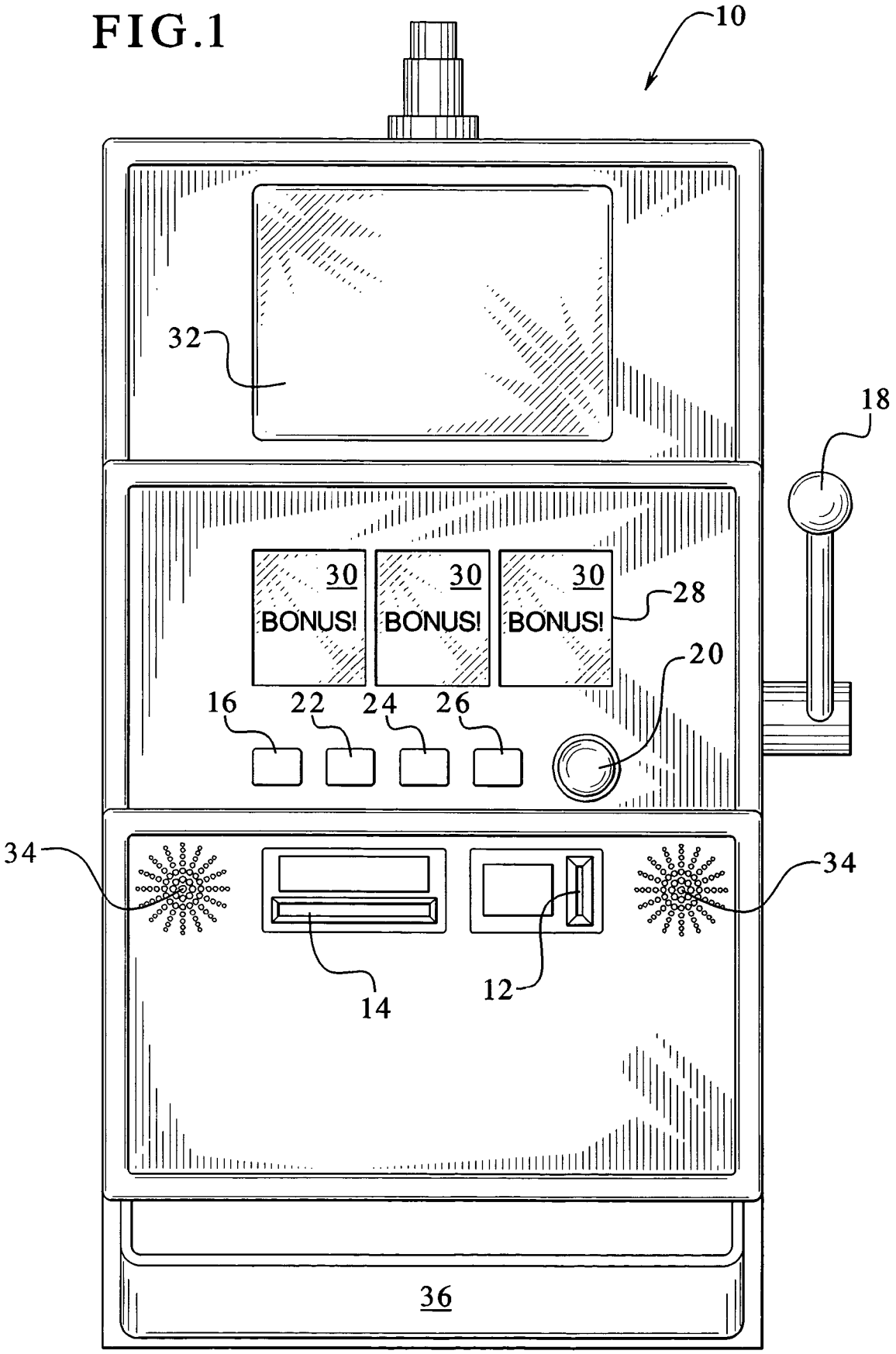
FIG. 1 is a front elevational view of a general embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. The present invention preferably employs or uses credits, however, the present invention is not limited to the use of credits and contemplates employing other units of value such as money. For purposes of describing and claiming this invention, the term "credit" includes any unit of value such as a gaming device credit or actual money.

After depositing the appropriate amount of money, a player can begin the game by pulling arm 18 or by pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 which contains a plurality of reels 30, preferably three to five reels in mechanical or video form. Each reel 30 displays a plurality of symbols such as bells, hearts, martinis, fruits, cactuses, numbers, cigars, letters, bars or other images, which preferably correspond to a theme associated with the gaming device 10. If the reels 30 are in video form, the gaming device 10 preferably displays the video reels 30 in a display device described below. Furthermore, gaming device 10 preferably includes speakers 34 for making sounds or playing music.

A player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards that keep track of the player's credits.

With respect to electronics, the controller of gaming device 10 preferably includes the electronic configuration generally illustrated in FIG. 2, which has: a processor 38; a memory device 40 for storing program code or other data; a display device 32 (i.e., a liquid crystal display) described below; a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code, which controls the gaming device 10 so that it plays a particular game in accordance with applicable game rules and paytables.

Figure 2:
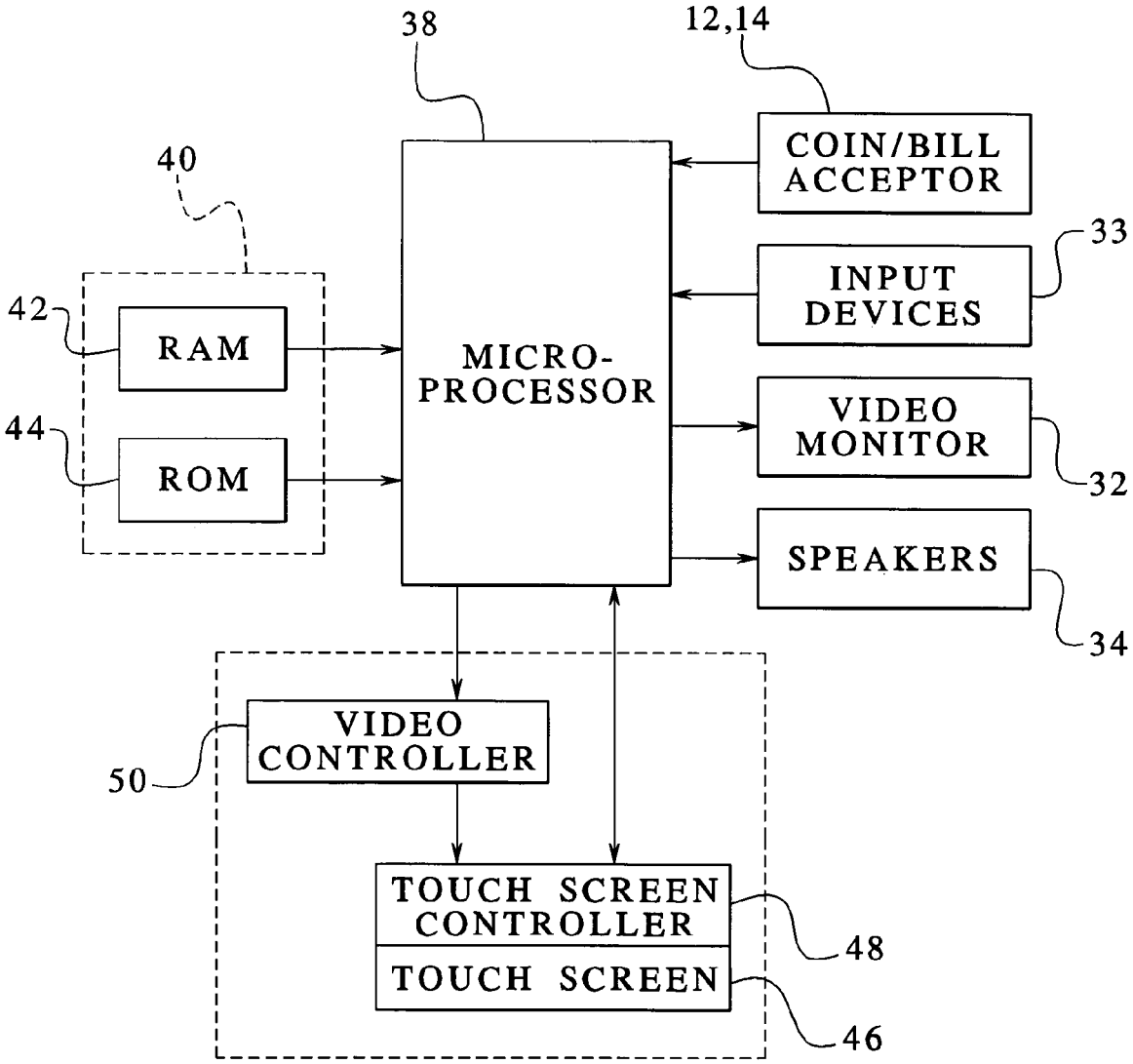
FIG. 2 is a schematic block diagram of the electronic configuration of one embodiment of the gaming device of the present invention.

As illustrated in FIG. 2, the player preferably uses the input devices 33, such as the arm 18, play button 20, the bet one button 24 and the cash out button 26 to input signals into gaming device 10. A touch screen 46 and an associated touch screen controller 48 are preferably used in conjunction with a display device described in detail below. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

Referring to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Round Components

Referring now to FIG. 3A, an enlarged front elevational view of the display device 32 of the present invention having a plurality of groups of player selectable masked awards is illustrated. In one group of player selectable masked awards, indicated by the number 52, the game displays masking indicia relating to the letter "A". That is, the masking indicia of the group 52 preferably relate to one theme, namely, the letter "A". In another group of player selectable masked awards, indicated by the number 54, the game displays masking indicia relating to the letter "B". In a further group of player selectable masked awards, indicated by the number 56, the game displays masking indicia relating to the letter "C". In yet another group of player selectable masked awards, indicated by the number 58, the game displays masking indicia relating to the letter "D". It should be appreciated that any theme could be used in place of the letters "A" to "D".

The display 32 of FIG. 3A also contains a suitable prompt 59 urging the player to select one of the masked awards from each group. FIG. 3A illustrates a visual prompt, although the present invention contemplates providing a suitable audio prompt, such as, "Select one award from groups 'A', 'B', 'C' and 'D'." The present invention preferably includes the four groups 52 through 58, as illustrated. The present invention can however include any number of groups, but preferably more than one group. The groups of the present invention preferably each include the five masked awards, as illustrated. The groups can however include any number of masked awards. The present invention preferably enables the player to select one of the masked awards per group. The invention contemplates, however, enabling the player to select any number except all the masked awards.

Referring now to FIG. 3B, the display device 32 illustrates example awards of the groups 52 through 58 illustrated above in FIG. 3A. The present invention can or cannot reveal such a display, however, the game does not reveal all the awards until the player has made all selections in a round, i.e., completed the game. Different groups can have different awards, however, each of the groups preferably contains the same array of award values. FIG. 3B illustrates each group having a 10 award, a 50 award, a 300 award, a 500 award and a 750 award. The groups can contain two or more of the same awards but preferably contain an array of different values as illustrated. The implementor can design the game to have any array of values that satisfy the payback algorithm of the game, as is well known in the art.

As mentioned, the game does not reveal or unmask awards while the player initially picks masked awards from each group or while the player attempts to optimize the award. The game reveals or unmasks awards, if at all, at the end of a round, when the player has no further selections. The game does preferably give some indication, however, of the particular symbol that the player chooses. For example, the game can remove the indicia "AA" from the group 52 of FIG. 3A and replace the indicia with a single color or other suitable selection indicator, so that the player does not forget and reselect the same masked award.

When the player changes the selection of a particular group, the game preferably replaces the selection indicator of the previously selected masked award with its original indicia, e.g., the indicia "AA". Alternatively, the game can display two awards with selection indicators, wherein the selection indicators can be the same or different for the first and second selected awards. The following examples illustrate the different methods of indicating selected symbols during the player's award optimization of the present invention.

Figure 3C:
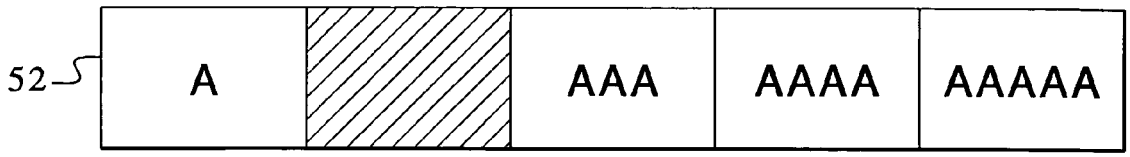
FIG. 3C is a schematic diagram having a group of player selectable masked awards, which illustrates a method for indicating a player's selection.

Referring to FIG. 3C, a method for indicating a player's selection is illustrated, wherein the present invention changes a selected masked symbol. FIG. 3C contains the row 52 of FIG. 3A displaying masking indicia relating to the letter "A". The player has selected the masked award "AA" and the game has marked or changed the award mask by removing the "AA" indicia and adding the cross-hatched lines. As stated above, the game can change the mask of a selected award by adding a solid color or any other desired selection indicator. The game can also leave the "AA" indicia and instead highlight, embolden, change the color of, rotate or otherwise distinguish or identify the selected "AA" indicia from the other non-selected indicia. Alternatively, (yet non-preferably) the present invention can provide a momentary indication that the player has made a selection, such as an accompanying sound or momentary highlight, but otherwise leave the "AA" unchanged and not highlighted.

Figure 3D:
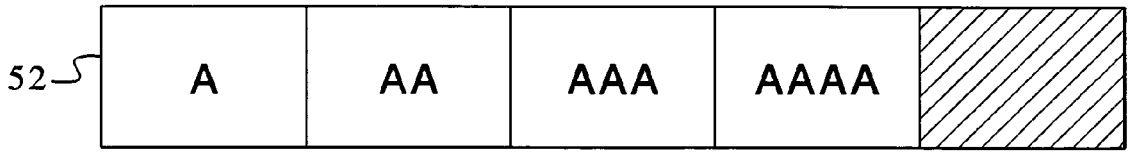
FIG. 3D is a schematic diagram having a group of player selectable masked awards, which illustrates one method for indicating a player's change of a selection.

Referring to FIG. 3D, one method for indicating a player's change of a selection or an attempt at optimization is illustrated, wherein the game removes the selection indicator and returns the initial mask or indicia of the formerly selected award. FIG. 3D is a continuation of the round of the present invention illustrated in FIG. 3C. The player has changed the selection of the group 52 from the "AA" award to the "AAAAA" award. The present invention now illustrates the cross-hatching over the "AAAAA" award of the group 52 and replaces the selection indicator of the previously selected "AA" award with the original "AA" masking indicia.

Figure 3E:
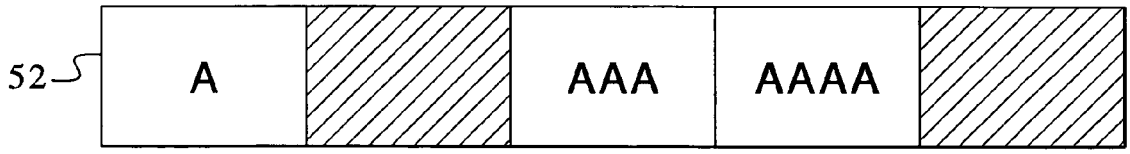
FIG. 3E is a schematic diagram having a group of player selectable masked awards, which illustrates another method for indicating a player's change of a selection.

Referring to FIG. 3E, another method for indicating a player's change of a selection or an attempt at optimization is illustrated, wherein the game leaves the initial selection indicator and adds the same selection indicator to the newly selected award. The game leaves the initial selection indicator, e.g., the cross-hatched lines, over the originally selected and now deselected "AA" award. The game also removes the "AAAAA" indicia from the newly selected award and adds the same selection indicator over the "AAAAA" award. Thus, both awards contain the same cross-hatching, however, only the "AAAAA" award currently adds to the player's total.

Figure 3F:
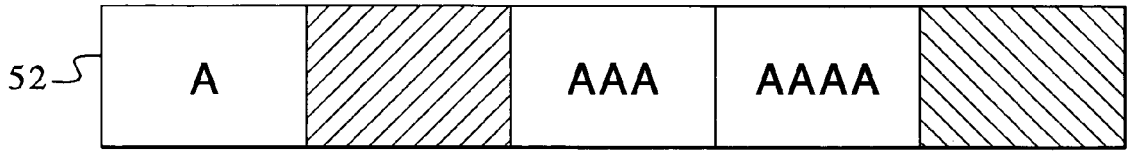
FIG. 3F is a schematic diagram having a group of player selectable masked awards, which illustrates a further method for indicating a player's change of a selection.

Referring to FIG. 3F, a further method for indicating a player's change of a selection or an attempt at optimization is illustrated, wherein the game leaves the initial selection indicator and adds a different selection indicator to the newly selected award. The game leaves the initial selection indicator, e.g., the cross-hatched lines, over the originally selected and now deselected "AA" award. The game also removes the "AAAAA" indicia from the newly selected award and adds the different selection indicator over the "AAAAA" award, e.g., cross-hatching having an oppositely sloping hatch. Thus both awards contain the some form of cross-hatching, however, only the "AAAAA" award currently adds to the player's total.

The display device 32 illustrated in FIGS. 3A, 3B, 7, 8, 9 and 10 preferably contains a touch screen 46 and an associated touch screen controller 48. Each of the masked awards of the groups "A", "B", "C" and "D" displayed on display device 32 is thus preferably a player selectable area, which sends a unique input signal to the controller of the present invention. Alternatively, the present invention contemplates providing one or more front panel mountable input devices 33, which are well known in the art, and that enable a player to select one or more masked awards from the groups.

Indicator Embodiments

Referring now to FIG. 4, one optimization embodiment is illustrated wherein the present invention reveals the total credits selected after the player selects a masked award from each group. The total credit indicator 60 is preferably a simulated display on the display device 32 (not shown). The game can alternatively provide a front panel mountable electromechanical total credit indicator 60. The total credit indicator 60 preferably displays nothing or "0" until the player selects masked awards from each of the groups.

The total credit indicator 60 preferably does not initially display the value of each incremental masked award selection before a player selects an award from all of the groups 52 through 58 of FIG. 3A. The game, rather, displays the total after the player initially selects one or more awards from each of the groups. A player would otherwise know the value of each initial selection, rendering the game unchallenging. After the player selects an initial masked award from all of the groups, and the game enables the player to optimize the total award, the game preferably updates the total credit indicator 60 after each change or new selection. It should be appreciated, however, that the total award indicator either displays nothing, a zero or an accumulation of at least one award selected from each group of the present invention.

The total credit indicator 60 thus enables a player to optimize an award by showing the effect of a change in the player's selection. That is, after the player initially selects a masked award from each group, e.g., groups "A" through "D" of FIG. 3A, the game displays the total, such as the 1150 credits of FIG. 4, in the total credit indicator 60. The game then enables the player to change a selection of one of the groups and updates the change in the total credit indicator 60. The player can then selectively change back to the original selection or once again select another masked award. The game enables a plurality of award changes and preferably enables three.

Referring now to FIG. 5, another optimization embodiment is illustrated wherein the present invention reveals each possible selectable credit as well as the total credits selected after the player selects a masked award from each group. The selectable credit indicator 62 is illustrated as a sentence disclosing that, "each group has the awards: 10 credits; 50 credits; 300 credits; 500 credits; and 750 credits." The present invention can display the selectable credit indicator at any time and does not require the player to first make a selection or to make a selection from each group. The optimization embodiment of FIG. 5 also preferably contains the total credit indicator 60 discussed above in addition to the selectable credit indicator 62.

It should be appreciated that the present invention can display the selectable credit indicator 62 in a tabulated or graphical format as opposed to the literal format illustrated in FIG. 5. It should also be appreciated that the present invention can have groups containing award values different from that of other groups. In such a case, the present invention preferably displays all possible award values in the selectable credit indicator 62. The message of the selectable credit would accordingly change, e.g., to "each group can have the awards: . . . " Additionally, a selectable credit indicator could be associated within more than one or with each group.

In the optimization embodiment of FIG. 5, the selectable credit indicator 62 operates in conjunction with the total credit indicator 60. The total credit indicator 60 discloses a relative change in the player's overall award, i.e., a step in the right or wrong direction, while the selectable credit indicator 62 discloses the desirability of the player's current selections on an absolute or optimal basis.

In an example illustrating the optimization embodiment of FIG. 5, the game contains the selectable credit indicator 62 disclosing that, "each group has the awards: 10 credits; 50 credits; 300 credits; 500 credits; and 750 credits." The player changes a pick from "A" to "AAAAA" in the group 52 of FIG. 3A, and that the total credit indicator 60 updates a total of 910 credits to 950 credits. The player knows that the only combination that can account for the forty credit difference on the total credit indicator 60 is the 10 credit and 50 credit combination. The player also knows that these are the two lowest possible awards from the selectable credit indicator 62. The player's next move should thus be to select the "AA", "AAA" or "AAAA" from the group 52, with the knowledge that at worst the player will win 300 credits from the group 52.

The selectable credit indicator 62 also aids the player when determining whether to make a change or an attempt to optimize with a final, irreversible selection. If the player knows from the selectable credit indicator that the ultimate award is, e.g., 3000 (4×750) and that the average award is, e.g., 1288 (4×((10+50+300+500+750)/5)), then if the total credit indicator 60 currently displays 410 credits, then the player should opt to employ the final change or optimization attempt because it will likely increase the total. If the total credit indicator 60 currently displays 2500 credits, then the player should opt not to employ the final change without other information.

Referring now to FIG. 6, a further optimization embodiment is illustrated wherein the present invention reveals each possible selectable credit and the number of each credit that the player has currently selected. The current credit indicator 64 preferably works in conjunction with the selectable credit indicator 62 to provide the player with an indication of the possible credit selections and also with the current number of each selected. It should be appreciated the selectable credit indicator 62 and the current credit indicator 64 enable the player to calculate the player's current total credits and therefore obviate the need for the total credit indicator 60. As a matter of convenience, however, the present invention preferably provides the total credit indicator 60, so that the player does not have to continuously add credits. The present embodiment can alternatively operate without the total credit indicator 60.

In the embodiment of FIG. 6, the selectable credit indicator 62 discloses that each group has the awards of: 10 credits; 50 credits; 300 credits; 500 credits; and 750 credits. The current credit indicator 64 discloses that the player has selected one 10 credit, two 50 credits and one 300 credit. The total credit indicator 60 discloses that the player has selected a total of 450 credits. The optimization embodiment preferably makes no association, however, between the credit values and a specific masked award. Although the player knows the values of each selected masked award, the player does not know which value belongs to which masked award.

It should be appreciated that the above combination is the only possible combination yielding 450 credits. The player can therefore determine the current selected number of each selectable credit from the selectable credit indicator 62 and the total credit indicator 60. Many credit totals of the present invention, especially ones of relatively low value, have only one possible combination as illustrated here. In these unique combination situations, the current credit indicator 64 functions as an aid to the player; i.e., the game determines the combination for the player. The aid obviates the need for the player to determine the combination and also to determine whether or not the combination is unique with respect to the total.

If, in the example wherein the selectable credit indicator 62 discloses that each group has the awards of: 10 credits; 50 credits; 300 credits; 500 credits; and 750 credits and the total credit indicator 60 discloses a total credit of 1150 credits, the current credit indicator serves another purpose, namely, to distinguish between two or more possibilities.

One 50 credit, two 300 credits and one 500 credit yield a total of 1150 credits. Two 50 credits, one 300 credit and one 750 credit also yield 1150 credits. Likewise, one 300 credit and three 500 credits total 1800 credits, as does one 50 credit, two 500 credits and one 750 credit.

When a credit total has multiple constituent combinations as shown above, the current credit indicator 64 enables the player to easily distinguish between an upgrade from 50 credits to 300 credits and an upgrade from 500 credits to 750 credits, wherein each upgrade is 250 credits. A player can determine the actual values knowing the different combinations yielding the total value before the change, the different combinations of symbols yielding the total value after the change and the different combinations yielding the change. However, the procedure is involved (shown below) and the present invention preferably contains the current credit indicator 64 to place different players on equal footing.

Example of Bonus Round

Figure 7:
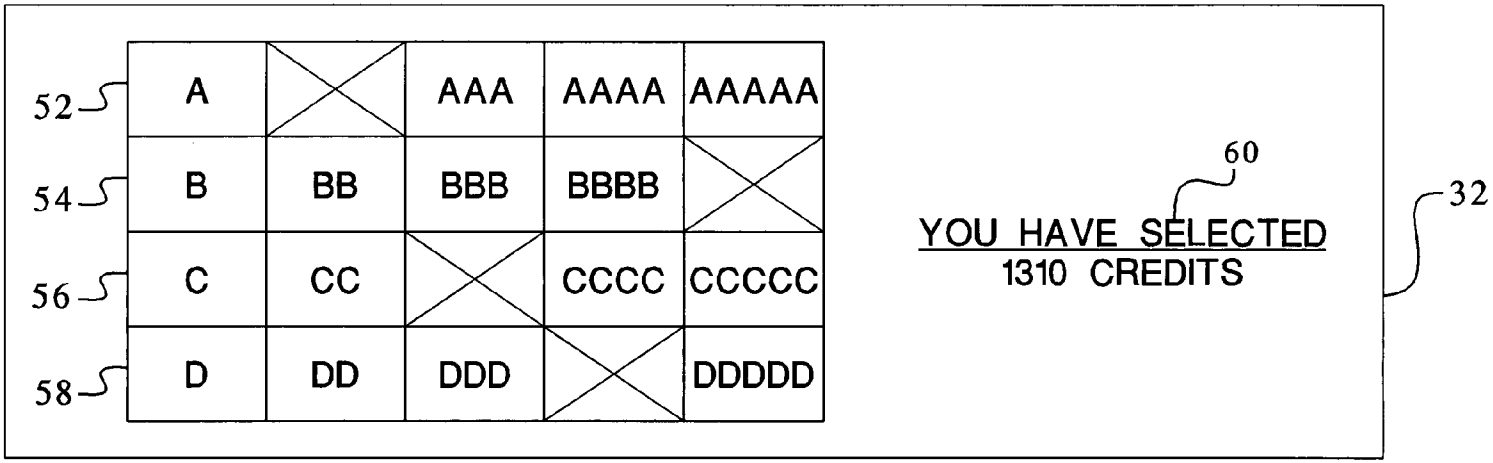
FIG. 7 is an enlarged front elevational view of the display device of the present invention illustrating one example of a plurality of groups having player selected masked awards.

Referring to FIGS. 3A, 7, 8, 9 and 10, an example of the present invention is illustrated using each of the different optimization embodiments. The game preferably only employs one embodiment, however for illustration purposes, the following example illustrates all three. In FIG. 3A, the game displays four rows 52 through 58 each having five selectable similarly masked awards. The game directs the player to select a masked award from each row through a suitable audio and/or video prompt such as the message 59. FIG. 7 illustrates that the game has placed a selection indicator, e.g., the "X", on the awards of the player's first selections, namely, the "AA" from the row 52, the "BBBBB" from the row 54, the "CCC" from the row 56 and the "DDDD" from the row 58. A total credit indicator 60 comprises one optimization embodiment and shows a total of 1310 credits.

Figure 8:
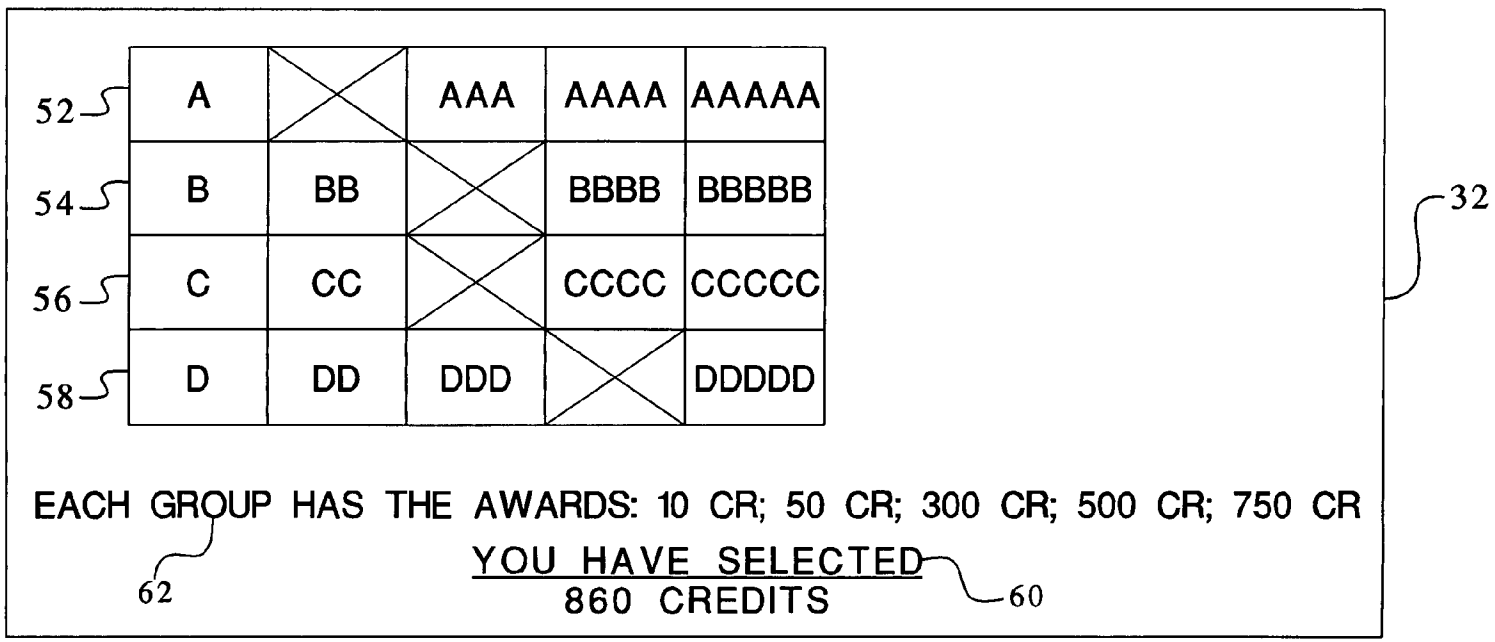
FIG. 8 is an enlarged front elevational view of the display device of the present invention illustrating another example of a plurality of groups having player selected masked awards.

The game enables the player, as preferred, to have three opportunities to upgrade the total award or credits, wherein an opportunity preferably includes changing one selection. Alternatively, the opportunity can include changing a plurality of selections, such as one selection per row. Changing a plurality of selections makes diagnosing the cause of a resulting change too difficult and could lessen player enjoyment. With three chances, the game guarantees the player an opportunity to fix an undesirable change after the initial selection from each row. Even though the total credit indicator 60 of FIG. 7 gives the player no idea where to make a change, the player incurs no risk by selecting the "BBB" as illustrated in FIG. 8. FIG. 8 illustrates that the game removed the selection indicator from the previously selected "BBBBB" and placed it on the "BBB". The game discloses that the change lowered the player's total award to 860 credits as indicated by the total credit indicator 60.

In the optimization embodiment illustrated by FIG. 8, the game also contains a selectable credit indicator 62, which discloses that each group has the awards of: 10 credits; 50 credits; 300 credits; 500 credits; and 750 credits. With these awards, the player knows that one 10 credit, two 50 credits, and one 750 credits yield 860 total credits, as does one 10 credit, one 50 credit, one 300 credit and one 500 credit. The player also knows the difference between the first total award of 1310 and the second total award of 860 is 450 credits. This decrease could be from a change from 750 credits to 300 credits or from a change from 500 credits to 50 credits.

The player thus knows the following:

(1) 10+50+500+750=1310; and
10+300+500+500=1310;

(2) 750−300=450; and
500−50=450;

(3) 10+50+50+750=860; and
10+50+300+500=860.

Therefore, the player does not know which change the player's selection made. In other examples, it may be possible for the player to know which change was made, such as a change from a 750 credit to a 10 credit where the spread is so large, there is only one possibility.

Figure 9:
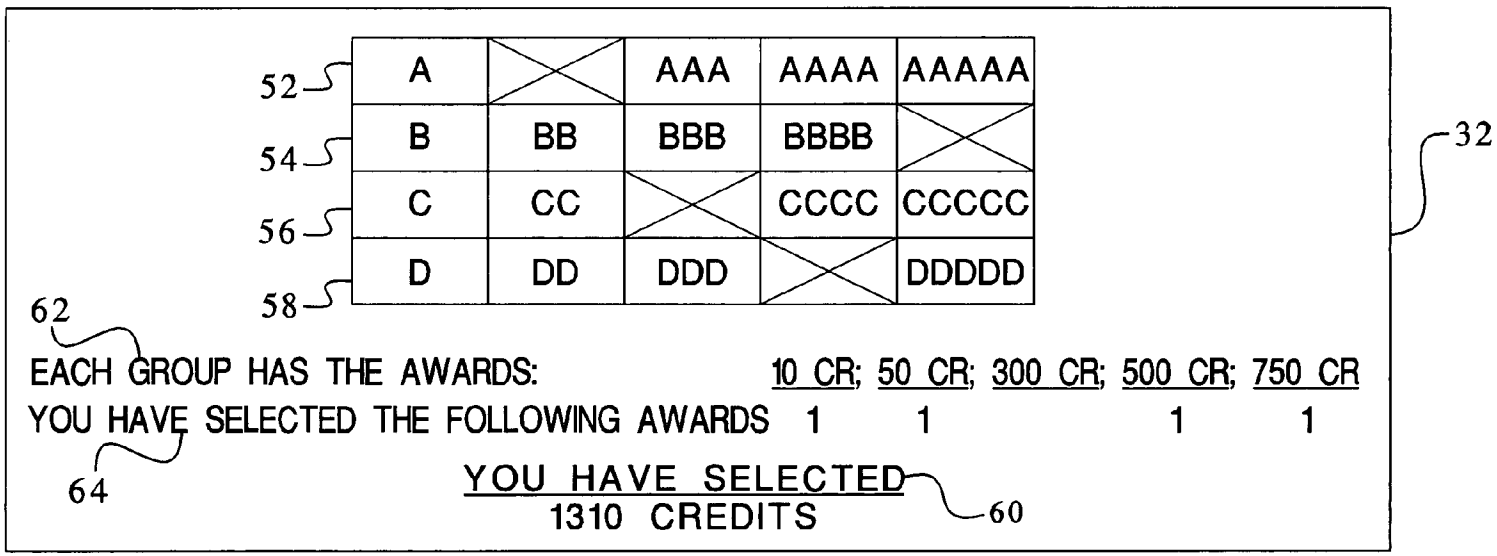
FIG. 9 is an enlarged front elevational view of the display device of the present invention illustrating a further example of a plurality of groups having player selected masked awards.

Referring now to FIG. 9, knowing now that the "BBBBB" contains a 750 and that the 450 credits can be retrieved, the player reselects the "BBBBB". FIG. 9 illustrates that the game removed the selection indicator from the previously selected "BBB" and replaced it on the "BBBBB". The figure also illustrates the update back to the original total of 1310 credits in the total credit indicator 60. In the optimization embodiment further illustrated by FIG. 9, the game also contains a selectable credit indicator 62 and the current credit indicator 64, which automatically discloses the information calculated by the player in FIG. 8.

At this point, the player has one selection remaining, which means that the game provides no further selections to undo an undesirable selection. The player can determine the average (calculated above), which is 1288. The player's total, 1310, is slightly above the average, so the odds dictate to forgo the final selection. The game provides a suitable "collect" input device (not shown) as is well known in the art, should the player decide to keep the current credit selection. The player knows, from the indicators that three 750's remain, and for excitement and enjoyment, decides to take the slight risk and make the final selection.

Figure 10:
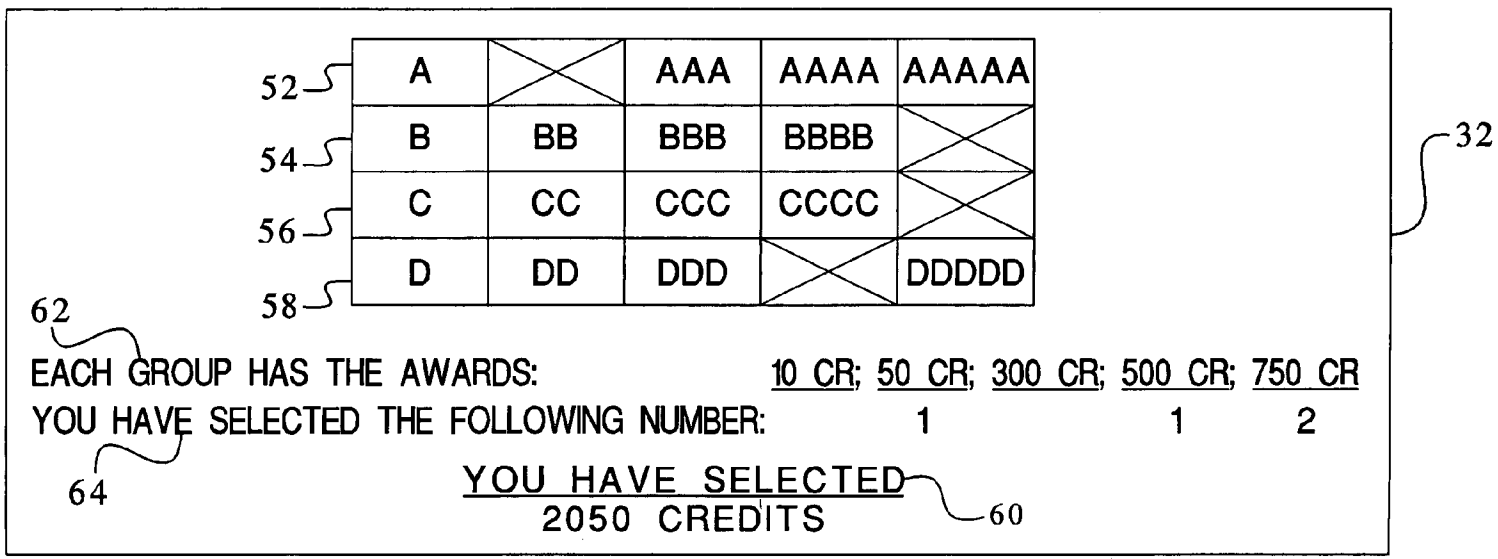
FIG. 10 is an enlarged front elevational view of the display device of the present invention illustrating yet another example of a plurality of groups having player selected masked awards.

As illustrated in FIG. 10, the player's final selection paid off as the change from the "CCC" to the "CCCCC" converted a 10 credit to a 750 credit. The game removed the selection indicator from the "CCC" and placed it on the "CCCCC". The selectable credit indicator 62 and the current credit indicator 64 indicate that the player currently has selected one 50 credit, one 500 credit and two 750 credits. The total credit indicator 60 updates and displays a total credit of 2050. Since no changes of optimization opportunities remain, the bonus round preferably automatically ends, and the game updates the player's credit display 16, accordingly. The game can, at this point, alternatively reveal or not reveal each award, as illustrated by FIG. 3B.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a game;

a display device adapted to display the game;

a plurality of selections in the game;

a plurality of awards in the game, wherein said plurality of awards are associated with said plurality of selections; and a processor operable with said display device to control the play of the game by:

(a) displaying said plurality of selections;

(b) enabling a player to pick a plurality of said selections;

(c) forming and displaying an offer based on the awards associated with at least one of said picked selections without revealing which picked selections said offer is based on;

(d) enabling the player to accept or reject the offer;

(e) providing the offer to the player if the player accepts said offer;

(f) if the player rejects said offer:

(i) enabling the player to deselect at least one of said picked selections; and (ii) enabling the player to pick one of the plurality of unpicked selections for each deselected selection; and (g) repeating steps (c) to (f) unless the player accepts said offer or said offer is a final offer.

2. The gaming device of claim 1, wherein said processor is operable to further control the play of the game by enabling the player to deselect a plurality of said picked selections if the player rejects said offer.

3. The gaming device of claim 1, wherein said processor is operable to further control the play of the game by displaying a maximum possible offer based on the plurality of awards associated with the plurality of selections the player may pick.

4. The gaming device of claim 1, wherein said processor is operable to further control the play of the game by displaying the award associated with at least one of said picked selections without revealing which selections are associated with which awards.

5. The gaming device of claim 1, wherein said processor is operable to further control the play of the game by displaying the awards associated with a plurality but not all of said picked selections without revealing which selections are associated with which awards.

6. The gaming device of claim 1, wherein said processor is operable to further control the play of the game by displaying a value and a number of each of the same awards which are associated with the picked selections without revealing which selections are associated with which awards.

7. The gaming device of claim 1, wherein for each deselected selection, the player is enabled to pick one of said previously deselected selections.

8. A gaming device comprising:

a game;

a display device adapted to display the game;

a plurality of selections in the game;

a plurality of awards in the game, wherein said plurality of awards are associated with said plurality of selections; and a processor operable with said display device to control the play of the game by:

(a) displaying said plurality of selections;

(b) enabling a player to pick a plurality of said selections;

(c) forming and displaying an offer based on the awards associated with a plurality but not all of said picked selections without revealing which picked selections said offer is based on;

(d) enabling the player to accept or reject the offer;

(e) providing the offer to the player if the player accepts said offer;

(f) if the player rejects said offer:

(i) enabling the player to deselect at least one of said picked selections; and (ii) enabling the player to pick one of the plurality of unpicked selections for each deselected selection; and (g) repeating steps (c) to (f) unless the player accepts said offer or said offer is a final offer.

9. The gaming device of claim 8, wherein said processor is operable to further control the play of the game by enabling the player to deselect a plurality of said picked selections if the player rejects said offer.

10. The gaming device of claim 8, wherein said processor is operable to further control the play of the game by displaying a maximum possible offer based on the plurality of awards associated with the plurality of selections the player may pick.

11. The gaming device of claim 8, wherein said processor is operable to further control the play of the game by displaying the award associated with at least one of said picked selections without revealing which selections are associated with which awards.

12. The gaming device of claim 8, wherein said processor is operable to further control the play of the game by displaying the awards associated with a plurality but not all of said picked selections without revealing which selections are associated with which awards.

13. The gaming device of claim 8, wherein said processor is operable to further control the play of the game by displaying a value and a number of each of the same awards which are associated with the picked selections without revealing which selections are associated with which awards.

14. The gaming device of claim 8, wherein for each deselected selection, the player is enabled to pick one of said previously deselected selections.

15. A gaming device comprising:

a game;

a display device adapted to display the game;

a plurality of selections in the game;

a plurality of awards in the game, wherein said plurality of awards are associated with said plurality of selections; and a processor operable with said display device to control the play of the game by:

(a) displaying said plurality of selections;

(b) enabling a player to pick a plurality of said selections;

(c) forming and displaying an offer based on the awards associated with each of said picked selections without revealing which awards are associated with which picked selections;

(d) enabling the player to accept or reject the offer;

(e) providing the offer to the player if the player accepts said offer;

(f) if the player rejects said offer:

(i) enabling the player to deselect at least one of said picked selections; and (ii) enabling the player to pick one of the plurality of unpicked selections for each deselected selection; and (g) repeating steps (c) to (f) unless the player accepts said offer or said offer is a final offer.

16. The gaming device of claim 15, wherein said processor is operable to further control the play of the game by enabling the player to deselect a plurality of said picked selections if the player rejects said offer.

17. The gaming device of claim 15, wherein said processor is operable to further control the play of the game by displaying a maximum possible offer based on the plurality of awards associated with the plurality of selections the player may pick.

18. The gaming device of claim 15, wherein said processor is operable to further control the play of the game by displaying the award associated with at least one of said picked selections without revealing which selections are associated with which awards.

19. The gaming device of claim 15, wherein said processor is operable to further control the play of the game by displaying the awards associated with a plurality but not all of said picked selections without revealing which selections are associated with which awards.

20. The gaming device of claim 15, wherein said processor is operable to further control the play of the game by displaying a value and a number of each of the same awards which are associated with the picked selections without revealing which selections are associated with which awards.

21. The gaming device of claim 15, wherein for each deselected selection, the player is enabled to pick one of said previously deselected selections.

22. A gaming device comprising:

a game;

a display device adapted to display the game;

a plurality of selections in the game;

a plurality of different values in the game, wherein said plurality of values are associated with said plurality of selections; and a processor operable with said display device to control the play of the game by:

(a) displaying said plurality of selections;

(b) enabling a player to pick a plurality of said selections;

(c) displaying a number of each of said different values associated with the plurality of selections the player may pick;

(d) forming and displaying an offer based on the values associated with at least one of said picked selections without revealing which picked selections said offer is based on;

(e) for each of said plurality of different values, displaying a number of picked selections associated with said value without revealing which selections are associated with which values;

(f) enabling the player to accept or reject said offer;

(g) providing the offer if the player accepts said offer;

(h) if the player rejects said offer:

(i) enabling the player to deselect at least one of said picked selections; and (ii) enabling the player to pick one of the plurality of unpicked selections for each deselected selection; and (i) repeating steps (d) to (h) unless the player accepts said offer or said offer is a final offer.

23. The gaming device of claim 22, wherein said processor is operable to further control the play of the game by enabling the player to deselect a plurality of said picked selections if the player rejects said offer.

24. The gaming device of claim 22, wherein said processor is operable to further control the play of the game by forming and displaying an offer based on the values associated with a plurality of said picked selections without revealing which picked selections said offer is based on.

25. The gaming device of claim 22, wherein for each deselected selection, the player is enabled to pick one of said previously deselected selections.

26. A gaming device comprising:

a game;

a display device adapted to display the game;

a plurality of selections in the game;

a plurality of awards in the game, wherein said plurality of awards are associated with said plurality of selections;

a number of deselection opportunities; and a processor operable with said display device to control the play of the game by:

(a) displaying said plurality of selections;

(b) enabling a player to pick a plurality of said selections;

(c) forming and displaying an offer based on the awards associated with at least one of said picked selections;

(d) enabling the player to accept or reject said offer;

(e) providing the offer to the player if the player accepts said offer;

(f) if the player rejects said offer and has at least one deselection opportunity remaining:

(i) enabling the player to deselect at least one of said picked selections;

(ii) enabling the player to pick one of the plurality of unpicked selections for each deselected selection to form at least another offer; and (iii) reducing the number of deselection opportunities for each deselected selection; and (g) repeating steps (c) to (f) until the player has no deselection opportunities remaining or the player accepts said offer or said offer is a final offer.

27. The gaming device of claim 26, wherein said processor is operable to further control the play of the game by enabling the player to deselect a plurality of said picked selections if the player rejects said offer.

28. The gaming device of claim 26, wherein said processor is operable to further control the play of the game by forming and displaying an offer based on the awards associated with a plurality of said picked selections.

29. The gaming device of claim 26, wherein for each deselected selection, the player is enabled to pick one of said previously deselected selections.

30. A gaming device comprising:

a game;

a display device adapted to display the game;

a plurality of selections in the game;

a plurality of awards in the game, wherein said plurality of awards are associated with said plurality of selections; and a processor operable with said display device to control the play of the game by:

(a) displaying said plurality of selections;

(b) enabling a player to pick at least one of said selections;

(c) forming and displaying an offer based on the award associated with at least one of said selections;

(d) enabling the player to accept or reject the offer;

(e) providing the offer to the player if the player accepts said offer; and (f) if the player rejects said offer:

(i) enabling the player to deselect at least one of said picked selections;

(ii) enabling the player to pick one of the plurality of unpicked selections for each deselected selection;

(iii) forming and displaying another offer based on the award associated with at least one of the picked selections; and (iv) enabling the player to accept or reject the other offer.

31. The gaming device of claim 30, wherein said processor is operable to further control the play of the game by enabling the player to pick a plurality of said selections.

32. The gaming device of claim 30, wherein said processor is operable to further control the play of the game by enabling the player to deselect a plurality of said picked selections if the player rejects said offer.

33. The gaming device of claim 30, wherein said processor is operable to further control the play of the game by forming and displaying each offer based on the awards associated with a plurality of said selections.

34. The gaming device of claim 30, wherein for each deselected selection, the player is enabled to pick one of said previously deselected selections.

35. A gaming device comprising:

a game;

a display device adapted to display the game;

a plurality of selections in the game;

a plurality of groups of the selections in the game;

a plurality of awards in the game, wherein said plurality of awards are associated with said plurality of selections; and a processor operable with said display device to control the play of the game by:

(a) displaying said plurality of selections;

(b) enabling the player to select at least one selection from each of said groups of selections;

(c) forming and displaying an offer based on the awards associated with said picked selections without revealing which awards are associated with which picked selections;

(d) enabling the player to accept or reject said offer;

(e) providing the offer to the player if the player accepts said offer;

(f) if the player rejects said offer:

(i) enable the player to deselect at least one of said picked selections, and (ii) for each deselected selection, enabling the player to pick one of the plurality of unpicked selections from the same group as the deselected selection; and (g) repeating steps (c) to (f) unless the player accepts said offer or said offer is a final offer.

36. The gaming device of claim 35, wherein said processor is operable to further control the play of the game by enabling the player to deselect a plurality of said picked selections if the player rejects said offer.

37. The gaming device of claim 35, wherein for each deselected selection, the player is enabled to pick one of said previously deselected selections.

38. A method of operating a gaming device, said method comprising:

(a) displaying a plurality of selections, wherein said plurality of selections are associated with a plurality of awards;

(b) enabling a player to pick a plurality of said selections;

(c) forming and displaying an offer based on the awards associated with at least one of said picked selections without revealing which picked selections said offer is based on;

(d) enabling the player to accept or reject the offer;

(e) providing the offer to the player if the player accepts said offer;

(f) if the player rejects said offer:

(i) enabling the player to deselect at least one of said picked selections; and (ii) enabling the player to pick one of the plurality of unpicked selections for each deselected selection; and (g) repeating steps (c) to (f) unless the player accepts said offer or said offer is a final offer.

39. The method of claim 38, which includes enabling the player to deselect a plurality of said picked selections if the player rejects said offer.

40. The method of claim 38, which includes displaying a maximum possible offer based on the plurality of awards associated with the plurality of selections the player may pick.

41. The method of claim 38, which includes displaying the award associated with at least one of said picked selections without revealing which selections are associated with which awards.

42. The method of claim 38, which includes displaying the awards associated with a plurality but not all of said picked selections without revealing which selections are associated with which awards.

43. The method of claim 38, which includes displaying a value and a number of each of the same awards which are associated with the picked selections without revealing which selections are associated with which awards.

44. The method of claim 38, wherein for each deselected selection, enabling the player to pick one of said previously deselected selections.

45. The method of claim 38, which includes operating the gaming device through a data network.

46. The method of claim 45, wherein the data network is an internet.

47. The method of claim 38, wherein computer instructions for implementing steps (a) to (g) are stored in a memory device.

48. A method of operating a gaming device, said method comprising:

(a) displaying a plurality of selections, wherein said plurality of selections are associated with a plurality of awards;

(b) enabling a player to pick a plurality of said selections;

(c) forming and displaying an offer based on the awards associated with a plurality of said picked selections without revealing which picked selections said offer is based on;

(d) enabling the player to accept or reject the offer;

(e) providing the offer to the player if the player accepts said offer;

(f) if the player rejects said offer:

(i) enabling the player to deselect at least one of said picked selections; and (ii) enabling the player to pick one of the plurality of unpicked selections for each deselected selection; and (g) repeating steps (c) to (f) unless the player accepts said offer or said offer is a final offer.

49. The method of claim 48, which includes enabling the player to deselect a plurality of said picked selections if the player rejects said offer.

50. The method of claim 48, which includes displaying a maximum possible offer based on the plurality of awards associated with the plurality of selections the player may pick.

51. The method of claim 48, which includes displaying the award associated with at least one of said picked selections without revealing which selections are associated with which awards.

52. The method of claim 48, which includes displaying the awards associated with a plurality but not all of said picked selections without revealing which selections are associated with which awards.

53. The method of claim 48, which includes displaying a value and a number of each of the same awards which are associated with the picked selections without revealing which selections are associated with which awards.

54. The method of claim 48, wherein for each deselected selection, enabling the player to pick one of said previously deselected selections.

55. The method of claim 48, which includes operating the gaming device through a data network.

56. The method of claim 55, wherein the data network is an internet.

57. The method of claim 48, wherein computer instructions for implementing steps (a) to (g) are stored in a memory device.

58. A method of operating a gaming device, said method comprising:

(a) displaying a plurality of selections, wherein said plurality of selections are associated with a plurality of awards;
(b) enabling a player to pick a plurality of said selections;
(c) forming and displaying an offer based on the awards associated with each of said picked selections without revealing which awards are associated with which picked selections;
(d) enabling the player to accept or reject the offer;
(e) providing the offer to the player if the player accepts said offer;
(f) if the player rejects said offer:
  (i) enabling the player to deselect at least one of said picked selections; and
  (ii) enabling the player to pick one of the plurality of unpicked selections for each deselected selection; and
(g) repeating steps (c) to (f) unless the player accepts said offer or said offer is a final offer.

59. The method of claim 58, wherein the player is enabled to unpick a plurality of said picked selections if the player rejects said offer.

60. The method of claim 58, which includes displaying a maximum possible offer based on the plurality of awards associated with the plurality of selections the player may pick.

61. The method of claim 58, which includes displaying the award associated with at least one of said picked selections without revealing which selections are associated with which awards.

62. The method of claim 58, which includes displaying the awards associated with a plurality but not all of said picked selections without revealing which selections are associated with which awards.

63. The method of claim 58, which includes displaying a value and a number of each of the same awards which are associated with the picked selections without revealing which selections are associated with which awards.

64. The method of claim 58, wherein for each deselected selection, enabling the player to pick one of said previously deselected selections.

65. The method of claim 58, which includes operating the gaming device through a data network.

66. The method of claim 65, wherein the data network is an internet.

67. The method of claim 58, wherein computer instructions for implementing steps (a) to (g) are stored in a memory device.

68. A method of operating a gaming device, said method comprising:

(a) displaying a plurality of selections, wherein said plurality of selections are associated with a plurality of different values;
(b) enabling a player to pick a plurality of said selections;
(c) displaying a number of each of said different values associated with the plurality of selections the player may pick;
(d) forming and displaying an offer based on the values associated with at least one of said picked selections without revealing which picked selections said offer is based on;
(e) for each of said plurality of different values, displaying a number of picked selections associated with said value without revealing which selections are associated with which values;
(f) enabling the player to accept or reject said offer;
(g) providing the offer if the player accepts said offer;
(h) if the player rejects said offer:
  (i) enabling the player to deselect at least one of said picked selections; and
  (ii) enabling the player to pick one of the plurality of unpicked selections for each deselected selection; and
(i) repeating steps (d) to (h) unless the player accepts said offer or said offer is a final offer.

69. The method of claim 68, which includes enabling the player to deselect a plurality of said picked selections if the player rejects said offer.

70. The method of claim 68, which includes forming and displaying an offer based on the values associated with a plurality of said picked selections without revealing which picked selections said offer is based on.

71. The method of claim 68, wherein for each deselected selection, enabling the player to pick one of said previously deselected selections.

72. The method of claim 68, which includes operating the gaming device through a data network.

73. The method of claim 72, wherein the data network is an internet.

74. The method of claim 68, wherein computer instructions for implementing steps (a) to (i) are stored in a memory device.

75. A method of operating a gaming device, said method comprising:

(a) displaying a plurality of selections, wherein said plurality of selections are associated with a plurality of awards;
(b) providing a player a number of deselection opportunities;
(c) enabling the player to pick a plurality of said selections;
(d) forming and displaying an offer based on the awards associated with at least one of said picked selections;
(e) enabling the player to accept or reject said offer;
(f) providing the offer to the player if the player accepts said offer;
(g) if the player rejects said offer and has at least one deselection opportunity remaining:
  (i) enabling the player to deselect at least one of said picked selections;

(ii) enabling the player to pick one of the plurality of unpicked selections for each deselected selection to form at least another offer; and (iii) reducing the number of deselection opportunities for each deselected selection; and (h) repeating steps (d) to (g) until the player has no deselection opportunities remaining or the player accepts said offer or said offer is a final offer.

76. The method of claim 75, which includes enabling the player to deselect a plurality of said picked selections if the player rejects said offer.

77. The method of claim 75, which includes forming and displaying an offer based on the awards associated with a plurality of said picked selections.

78. The method of claim 75, wherein for each deselected selection, enabling the player to pick one of said previously deselected selections.

79. The method of claim 75, which includes operating the gaming device through a data network.

80. The method of claim 79, wherein the data network is an internet.

81. The method of claim 75, wherein computer instructions for implementing steps (a) to (h) are stored in a memory device.

82. A method of operating a gaming device, said method comprising:

(a) displaying a plurality of selections, wherein said plurality of selections are associated with a plurality of awards;

(b) enabling a player to pick a plurality of said selections;

(c) forming and displaying an offer based on the award associated with at least one of said selections;

(d) enabling the player to accept or reject the offer;

(e) providing the offer to the player if the player accepts said offer; and (f) if the player rejects said offer:

(i) enabling the player to deselect at least one of said picked selections;

(ii) enabling the player to pick one of the plurality of unpicked selections for each deselected selection;

(iii) forming and displaying another offer based on the award associated with at least one of the picked selections; and (iv) enabling the player to accept or reject the other offer.

83. The method of claim 82, which includes enabling the player to unpick a plurality of said picked selections if the player rejects said offer.

84. The method of claim 82, wherein for each deselected selection, enabling the player to pick one of said previously deselected selections.

85. The method of claim 82, which includes operating the gaming device through a data network.

86. The method of claim 85, wherein the data network is an internet.

87. The method of claim 82, wherein computer instructions for implementing steps (a) to (f) are stored in a memory device.

88. A method of operating a gaming device, said method comprising:

(a) displaying a plurality of selection groups, wherein each selection group includes a plurality of selections and said plurality of selections are associated with a plurality of awards;

(b) enabling a player to select at least one selection from each of said groups of selections;

(c) forming and displaying an offer based on the awards associated with said picked selections without revealing which awards are associated with which picked selections;

(d) enabling the player to accept or reject said offer;

(e) providing the offer to the player if the player accepts said offer;

(f) if the player rejects said offer:

(i) enable the player to deselect at least one of said picked selections; and (ii) for each deselected selection, enabling the player to pick one of the plurality of unpicked selections from the same group as the deselected selection;

(g) repeating steps (c) to (f) unless the player accepts said offer or said offer is a final offer.

89. The method of claim 88, which includes enabling the player to unpick a plurality of said picked selections if the player rejects said offer.

90. The method of claim 88, wherein for each deselected selection, enabling the player to pick one of said previously deselected selections.

91. The method of claim 88, which includes operating the gaming device through a data network.

92. The method of claim 91, wherein the data network is an internet.

93. The method of claim 88, wherein computer instructions for implementing steps (a) to (g) are stored in a memory device.

94. A method for operating a gaming device, said method comprising:

(a) displaying a plurality of symbols, wherein a plurality of award values are associated with the symbols;

(b) enabling a player to select a plurality of the displayed symbols;

(c) displaying an indicator which shows the award values of a plurality of the selected symbols relative to a maximum total award value available to the player;

(d) enabling the player to deselect at least one of the selected symbols;

(e) enabling the player to select one of the selected symbols for each deselected symbol; and (f) providing at least one of the award values associated with the selected symbols to the player.

95. The method of claim 94, which includes operating the gaming device through a data network.

96. The method of claim 95, wherein the data network is an internet.

97. The method of claim 94, wherein computer instructions for implementing steps (a) to (f) are stored in a memory device.

* * * * *